US006619370B2

(12) United States Patent
Sakamoto et al.

(10) Patent No.: US 6,619,370 B2
(45) Date of Patent: Sep. 16, 2003

(54) METHOD AND APPARATUS FOR SEMI-MOLTEN METAL INJECTION MOLDING

(75) Inventors: Kazuo Sakamoto, Aki-gun (JP); Kyoso Ishida, Aki-gun (JP); Yukio Yamamoto, Aki-gun (JP)

(73) Assignee: Mazda Motor Corporation (JP)

( * ) Notice: Subject to any disclaimer, the term of this patent is extended or adjusted under 35 U.S.C. 154(b) by 0 days.

(21) Appl. No.: 09/345,487

(22) Filed: Jul. 1, 1999

(65) Prior Publication Data

US 2002/0017371 A1 Feb. 14, 2002

(30) Foreign Application Priority Data

Jul. 3, 1998 (JP) ..... P10-189162

(51) Int. Cl.[7] ..... B22D 27/09
(52) U.S. Cl. ..... 164/113; 164/900
(58) Field of Search ..... 164/113, 900, 164/119, 312

(56) References Cited

U.S. PATENT DOCUMENTS 4,694,882 A 9/1987 Busk
5,531,261 A * 7/1996 Yoshida et al. ..... 164/113
5,685,357 A * 11/1997 Kato et al. ..... 164/113
5,693,158 A * 12/1997 Yamamoto et al. ..... 148/557
5,901,778 A * 5/1999 Ichikawa et al. ..... 164/480

FOREIGN PATENT DOCUMENTS

| | | |
|---|---|---|
| EP | 0 572 683 A1 | 12/1993 |
| EP | 0 701 002 A1 | 3/1996 |
| JP | 62 279061 | 12/1987 |
| JP | 2-015620 | 4/1990 |

* cited by examiner

*Primary Examiner*—M. Alexandra Elve
*Assistant Examiner*—Len Tran
(74) *Attorney, Agent, or Firm*—Nixon Peabody LLP; Donald R. Studebaker

(57) ABSTRACT

In a semi-molten metal injection molding method of producing a thin molded product by injecting a semi-molten metal M of a magnesium alloy, in a semi-melting state, into a cavity of a mold through a product gate, characterized in that it is made possible to obtain a high-quality thin molded product by maintaining satisfactory fluidity of the semi-molten metal M. A grain size of the solid fraction in the melt M is set to not more than 0.13 times the average thickness of the product portion of the thin molded product and a molten metal velocity at the product gate is set to not less than 30 m/s and, moreover, a solid fraction Fs (%) of the semi-molten metal M and a grain size D ($\mu$m) of the solid phase of the semi-molten metal M are set so as to define the relationship $Fs \times D \leqq 1500$.

5 Claims, 6 Drawing Sheets

METHOD AND APPARATUS FOR SEMI-MOLTEN METAL INJECTION MOLDING

BACKGROUND OF THE INVENTION

1. Field of the Invention

The present invention relates to a method of semi-molten metal injection molding to mold thin products from a semi molten metal, and an apparatus for producing the same.

2. Prior Art

As a method of producing metal molded articles having higher internal quality than that made by die-casting method, semi-molten metal injection molding method has been known, in which molten metal (for example, magnesium alloy), in a semi-melting state held at a temperature of not more than the liquidus temperature of the alloy is injected into a cavity of a mold, as disclosed in Japanese Patent Publication JP-B 2-015620, corresponding to U.S. Pat. No. 4,694,882. Since the method of semi-molten metal injection molding method is possible to mold the melt at relatively low temperatures, it can have longer useful life of the mold than the die-casting method, and moreover, improve molding accuracy for products.

When thin molded products having thickness of not more than 1.5 mm in a product portion corresponding to a narrow cavity are formed by injection molding, the molten metal is solidified too rapidly in such a narrow cavity to mold the sound products. Thus, a higher injection speed is required for molding the melt without such a problem. The semi-molten metal injection molding is excellent without substantial burrs. For die casting, high-speed injection often provides much burrs, which are economically disadvantageous, and also causes disturbance in the molten metal flow, which leads to even lower internal quality.

In the method of semi-molten metal injection molding, however, since metal materials are molded in a semi-melting state at a temperature of not more than a liquidus temperature of the alloy, the fluidity of the molten metal tends to be lower to increase the possibility of the cavity not completely to be filled with the semi-molten metal. Thus, Without proper molding conditions set, it would be difficult to apply semi-molten metal injection molding method to molding thin, sound products having no defects.

SUMMARY OF THE INVENTION

The present invention has been accomplished in consideration of the problems described above. An object of the present invention is to provide a method of the semi-molten melt injection molding of thin, sound products by setting the proper molding conditions to maintain the fluidity of the melt at a sufficient level.

Another object of the invention is to provide molding conditions to be set, for the semi-molten melt injection molding of thin, sound products.

Further object of the invention is to provide an apparatus for semi-molten metal injection molding of thin, sound products, by setting the proper molding conditions to maintain the fluidity of the melt at a sufficient level.

According to the present invention, in order to achieve the object described above, prior to semi-molten metal injection, the size of crystal grains suspended in the semi-molten melt is defined as being at a sufficiently lower fixed level with regard to average thickness of a product to be molded, not to reduce fluidity of the melt, then obtaining a very thin product with sufficient property.

In the invention, the molten metal is fed at a higher velocity at a product gate into the mold cavity to increase the fluidity of the semi-molten melt, then further improving the quality of the very thin molded product.

In the invention, solid fraction Fs in the semi-molten melt to be fed is defined as being in lower levels in relation to grain size D ($\mu$m) of the solid phase in the melt so as to increase in fluidity in feeding the melt into the narrow mold cavity, then, obtaining thin, sound products.

In the invention, an overflow gate is provided in the mold at a opposite side of the cavity to the product gate and the thickness of an overflow gate portion of the thin molded product corresponding to the overflow gate is set to be lower than the thickness of the product gate portion corresponding to the product, then, achieving sufficient degassing of the cavity to the overflow groove formed continuously past the overflow gate. This thereby improves the quality of the thin molded article as a whole.

DETAILED DESCRIPTION OF THE INVENTION

Figure 1:
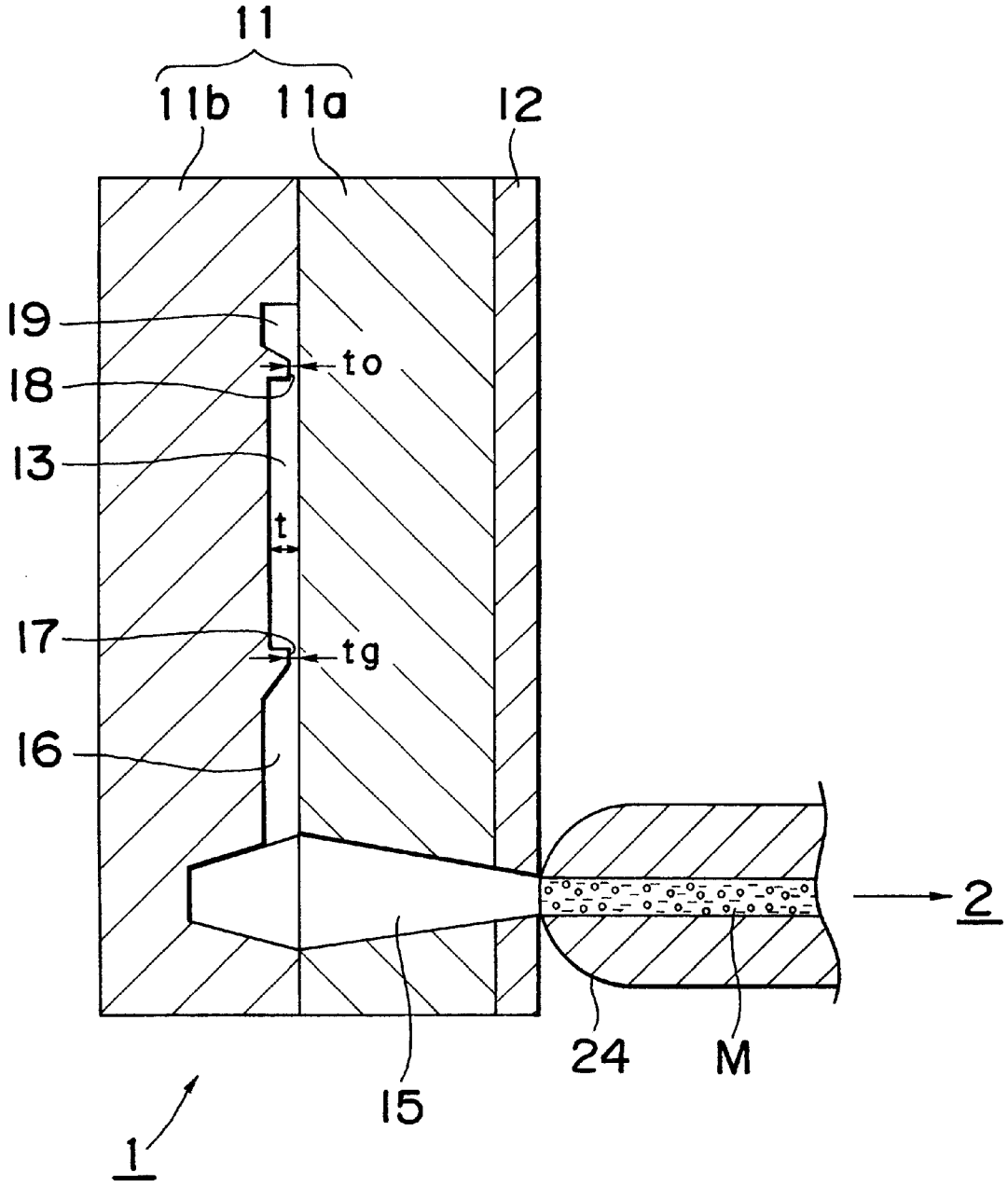
FIG. 1 is a schematic section view showing a mold for using in a semi-molten metal injection molding apparatus according to the embodiment of the present invention.
Figure 2:
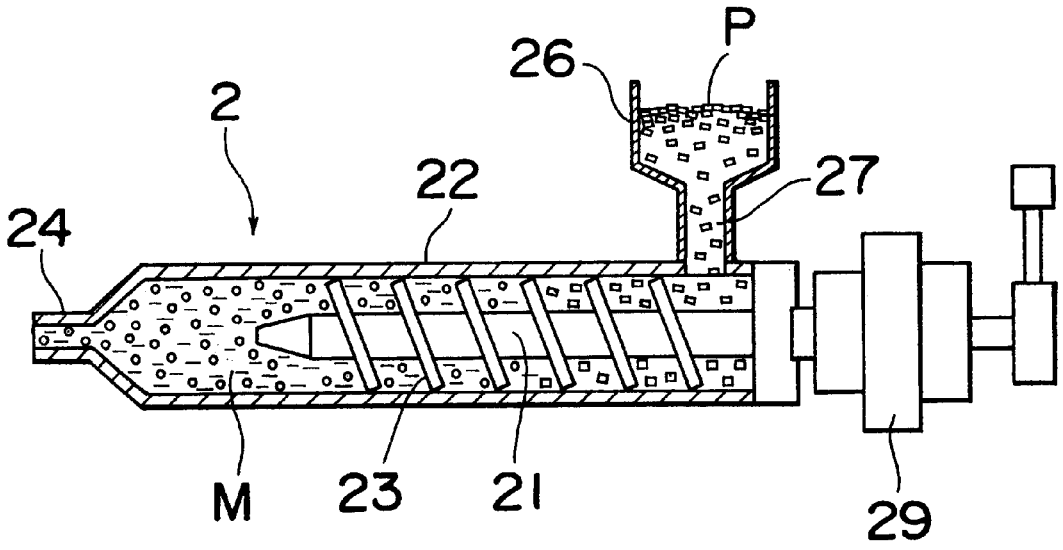
FIG. 2 is a schematic section view showing an injector for a the semi-molten metal injection molding apparatus.

The present invention will be described below with reference to the accompanying drawings. FIGS. 1 and 2 respectively show a apparatus for semi-molten metal injection molding, the apparatus being equipped with an injector 2 and a mold 1 provided with a cavity 13, wherein a melt M of a material is prepared in a solid metal mixture in the injector and injected into the cavity 13 of the mold 1 by the injector 2. The melt to be injected is heated in a heating cylinder of the injector to a state of semi-melting melt in a temperature range between the solidus and liquidus temperatures individual to the metallic material.

The present invention is directed to injection mold a thin articles with precision and without inner and outer defects due to the molding. The term "thin molded product" used in this specification refers to a molded article of which wall thickness is not more than 1.5 mm in 50% or more of the product portion, or a molded article wherein the volume of the product portion in $mm^3$ divided by the surface area (in $mm^2$) on both sides in the direction of thickness is not more than 0.75. Also, a portion of the thin molded product corresponding to the cavity 13 is called the product portion.

The injector 2 has an injection cylinder 22 as shown in FIG. 2, the injection cylinder 22 having a screw 23 fixed to a shaft 21 which is disposed therein rotatably and movably back and forth. The injection cylinder 22 also has a nozzle 24 provided integrally at the front end thereof.

Provided above a rear end of the injection cylinder 22 is a hopper 26 for charging a raw material. The hopper 26 is connected to the injection cylinder 22 via an argon replacing chamber 27 that is filled with argon. Thus the raw material charged into the hopper 26 may be passed through the argon atmosphere, which prevents oxidization of the raw material.

Shavings of a magnesium or magnesium alloy may be used as charging pellets of the raw material. In the below description this embodiment uses pellets of a magnesium alloy.

Disposed around the injection cylinder 22 and the nozzle 24 is a heater (not shown) which heats the charged pellets P inside the injection cylinder 22, while the pellets being agitated by the screw 23, thereby turning into a semi-molten metal M. The semi-molten metal M is in a semi-melting state at a temperature not higher than the liquidus temperature of the magnesium alloy, comprising solid and liquid mixed therein. The grain size D of the solid phase in the semi-molten metal M is set to not more than 0.13 times the average thickness T of the product portion of the thin molded product, then improve the sufficient fluidity of the semi-molten melt to filled the thin cavity with much less molding defects. If in such a solid-liquid mixture the solid grains have a larger average size D than 0.13 times the average thickness T causes significant deterioration in fluidity of the semi-molten metal M, thus making it impractical.

The grain size of the solid phase D can be controlled by adjusting a cycle time of molding (a time period that the semi-molten metal M to be injected next is heated up to a injection temperature and held at the temperature in the injection cylinder 22 after the previous melt is injected). Specifically, an increasing in molding cycle time causes aggregation and growth of solid particles in the melt, thereby increasing the grain size of the solid phase.

A solid fraction Fs of the semi-molten metal M, which is a percentage of an amount of the solid phase in the solid and liquid phases of the melt, can be controlled due to variations of melt temperatures by controlling the heaters (not shown) arranged around the cylinder 22, and is set so that Fs and the grain size D ($\mu$m) of the solid phase of the semi-molten metal M satisfy the relationship $Fs \times D \leqq 1500$. The value of $Fs \times D$ is set to not more than 1500 because the value larger than 1500 causes rapid deteioriation in fluidity of the semi-molten metal M.

The solid fraction Fs of the semi-molten metal M is set within a range from 3 to 40%. This is because a ratio smaller than 3% leads to higher temperature of the semi-molten metal M, and consequently excessive warp (exceeding 0.3 mm) in the product portion of the thin molded product, and the ratio higher than 40% tends to cause deterioration in fluidity of the semi-molten metal M.

Disposed at the rear end of the injection cylinder 22 is a high-speed injection mechanism 29 that advances the screw 23 thereby to eject the semi-molten metal M through the nozzle 24. As the pellets P or its semi-molten metal M is pushed forward by pushing the screw 23 forward, the pressure causes the screw 23 to withdraw (the withdrawal of the screw 23 is assisted hydraulically by a plunger), and when the screw has retreated by a predetermined stroke (a distance corresponding to a volume of semi-molten metal M ejected by one batch of molding), the high-speed injection mechanism 29 pushes the screw 23 forward to the former position.

The opening of the nozzle 24 is connected to a mold 1 for molding a semi-molten melt into a product, as shown in FIG. 1. The mold 1 comprises a fixed half mold 11*a* which is attached on a stationary plate 12 and a movable half mold 11*b* which mates with the fixed half mold 11*a* to form a cavity between the half molds 11*a* and 11*b*, and departs therefrom. The movable half mold 11*b* has a substantially the same configured recess on the mating surface as a profile of a product portion to be molded, while the fixed half mold 11*a* has a flat plane on the mating surface corresponding to the recess on the movable half mold 11*b*, to form a molding cavity 13 between the surfaces of both the half molds 11*a* and 11*b* when they are brought in contact.

Therefore, in the closed mold, an clearance between the recess and the plane of the fixed and movable half molds 11*a* and 11*b* is substantially equivalent to a thickness T of the corresponding product portion to be molded.

Disposed between the nozzle 24 and the cavity 13 are a spool 15, a runner 16 and a product gate 17 in sequence from the nozzle 24 side.

The mold 1 also has an overflow groove 19 over an overflow gate 18 provided on the opposite end (upper end) of the cavity 13 to the product gate 7, so that overflow groove 19 can escape residual air from the cavity 13 can escape due to flow of a injected melt into the cavity 13.

Both the product gate 17 and the overflow gate 18 are throttled to reduce thickness of the corresponding product portions of a thin molded product.

In the invention, the clearance between the fixed half mold 11*a* and movable half mold 11*b* in the overflow gate 18, namely, thickness To of the overflow gate portion that corresponds to the overflow gate 18 of the thin molded product, is set within a range from 0.1 to 1.0 times the clearance between the fixed half mold 11*a* and the movable half 11*b* in the product gate 17, namely the thickness Tg of the product gate portion corresponding to the product gate 17 of the thin molded product. When the thickness To of the overflow gate is smaller than 0.1 times the thickness Tg of the product gate portion, sufficient degassing to the overflow groove 19 cannot be achieved. On the other hand, when the ratio is larger than 1.0, the semi-molten metal M tends to fill the overflow groove 19 first thus blocking the path for degassing, resulting in lower internal quality of the thin molded product around the overflow gate 18 of the product portion. Thus the ratio is set within a range from 0.1 to 1.0.

The apparatus has such a construction as the semi-molten metal M is forced by the high-speed injection mechanism 29 through the nozzle 24, the spool 15, the runner 16 and the product gate 17, into the cavity 13, thereby to form the thin molded product. The velocity V of the molten metal passing through the product gate (speed at the product gate 17) is set to not less than 30 m/s. The molten metal velocity at the product gate is set to not less than 30 m/s because a velocity lower than 30 m/s leads to significant deterioration in fluidity of the semi-molten metal M.

The thin molded product is made by using the semi-molten metal injection molding apparatus in the following procedure. First, pellets P of an magnesium alloy are charged into the hopper 26, and the screw 23 rotates to push the pellets P that have been fed into the injection cylinder 22 forward to the nozzle 24 while kneading. At the same time, the pellets P are heated by the heater to turn into the semi-molten metal M in a semi-melting state, while the screw 23 retreats by the pressure generated in this process and the hydraulic pressure.

When the screw 23 has retreated by a predetermined distance, the screw 23 stops rotating, then the high-speed injection mechanism 29 is operated to advance the screw 23. This procedure causes the semi-molten metal M in a semi-melting state to be forced out of the nozzle 24 and fill the cavity 13 of the mold 1. At this time, since grain size D ($\mu$m) of the solid phase of the semi-molten metal M is set to not more than 0.13 times the average thickness T of the product portion of the thin molded product, the velocity the molten metal at the product gate is set to not less than 30 m/s and, moreover, the solid fraction Fs of the semi-molten metal N is set so as to satisfy the relationship $Fs \times D \leqq 1500$, good fluidity of the semi-molten metal M can be maintained, Also because the thickness To of the overflow gate portion of the thin molded product is set within a range from 0.1 to 1.0 times the thickness Tg of the product gate portion, sufficient degassing the cavity 13 can be achieved. As a result, the cavity 13 can be perfectly filled with the semi-molten metal M.

After the semi-molten metal M is solidified by cooling, the mold 1 is opened to release the thin molded product from the mold, and unnecessary portions other than the product portion of the thin molded product are cut off. The product portion of the thin molded product thus obtained has uniformly good internal quality in any portion thereof. Moreover, since the solid fraction Fs of the semi-molten metal M is set within a range from 3 to 40%, better quality of the product portion can be maintained while minimizing deformation thereof.

It is more preferred to set the grain size of the solid phase D of the semi-molten metal M to not less than 0.1 times the average thickness T of the product portion of the thin molded product, to set the molten metal velocity at the product gate to not less than 50 in/$s_1$ and to set the solid fraction Fs of the semi-molten metal M so as to satisfy the relationship $Fs \times D \leqq 800$, which will further improve the fluidity of the semi-molten metal M.

The semi-molten metal injection molding apparatus according to the embodiment described above is preferable for making the thin molded product made of a magnesium alloy, though it can be applied also to other metals, particularly aluminum alloy.

EXAMPLES

The following Examples further illustrate the present invention in detail.

Firstly, two kinds of magnesium alloys (alloy A and alloy B) with different chemical compositions, as shown in Table 1, were prepared.

TABLE 1

| | Chemical composition (% by weight) | | | | | | |
|---|---|---|---|---|---|---|---|
| Alloy | Al | Zn | Mn | Fe | Ni | Cu | Mg |
| A | 6.2 | 0.9 | 0.23 | 0.003 | 0.0008 | 0.001 | bal. |
| B | 8.9 | 0.7 | 0.24 | 0.003 | 0.0008 | 0.001 | bal. |

Figure 6:
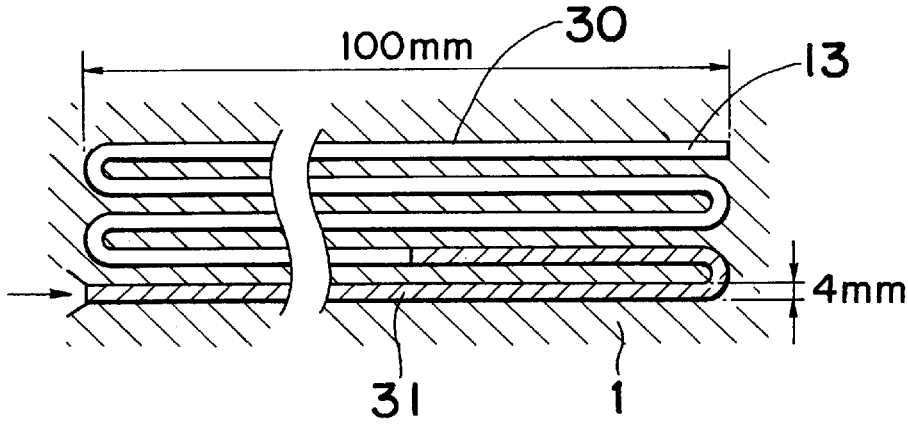
FIG. 6 is a schematic diagram showing a cavity configuration in a test mold used for fluidity tests.

Subsequently, the fluidity of the molten metal was tested using alloys A and B. Specifically, as shown in FIG. 6, a cavity 13 having a jetting shape was formed in a mold, and a molten metal was injected into the cavity 13 through a nozzle 24 of an injector 2, to evaluate the fluidity by the length of the solid metal 28 filling the cavity 13 from the product gate to the end (flow length). A difference in flow length was examined between a case where a ratio D/T of the grain size in the solid melt 28 to the average thickness of the product portion was changed, a case where the molten metal velocity at product gate V was changed, a case where the product of the solid fraction Fs (%) and the grain size of the solid phase D ($\mu$m) was changed (for alloy B only).

Figure 3:
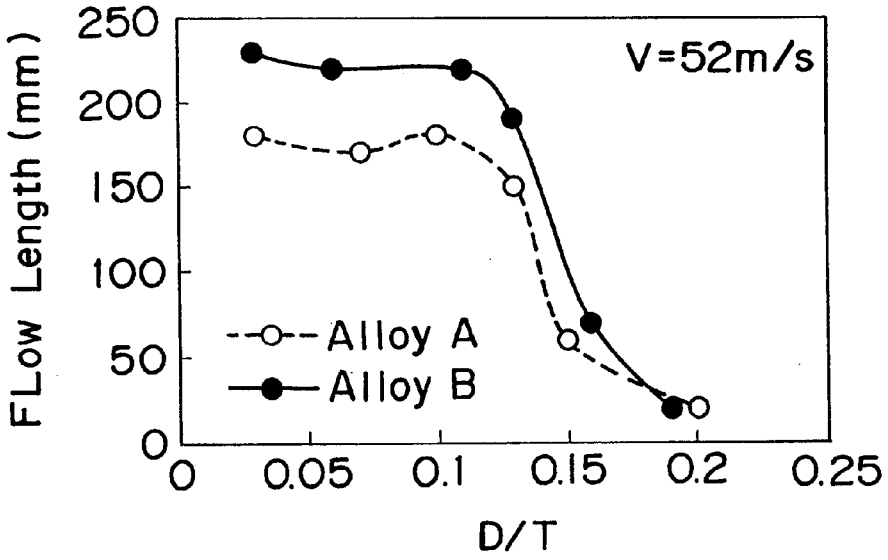
FIG. 3 is a graph showing a relationship of flow length of the melt in fluidity tests to a ratio D/T of grain size D of sold phase in the melt to average thickness T of a molded product.
Figure 4:
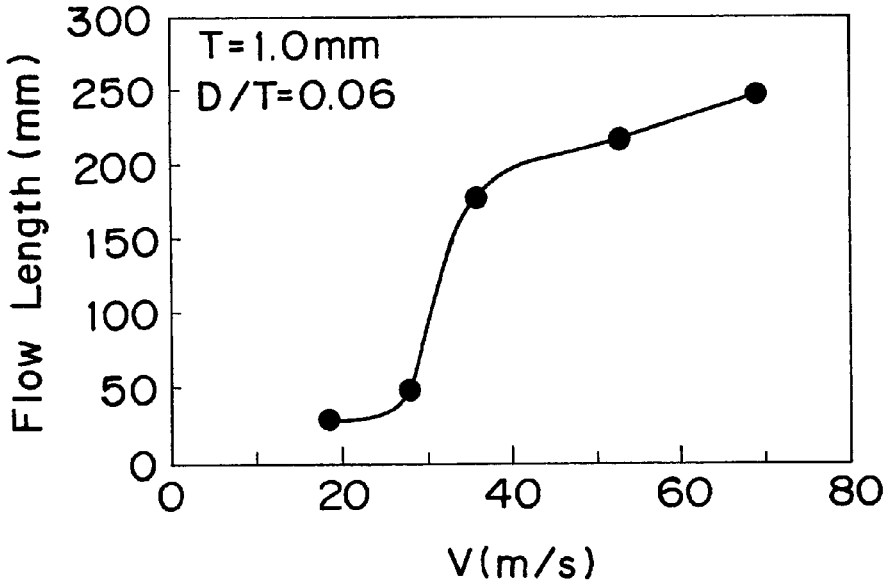
FIG. 4 is a graph showing a relationship between the molten metal velocity V at the product gate and the flow length measured by fluidity tests.
Figure 5:
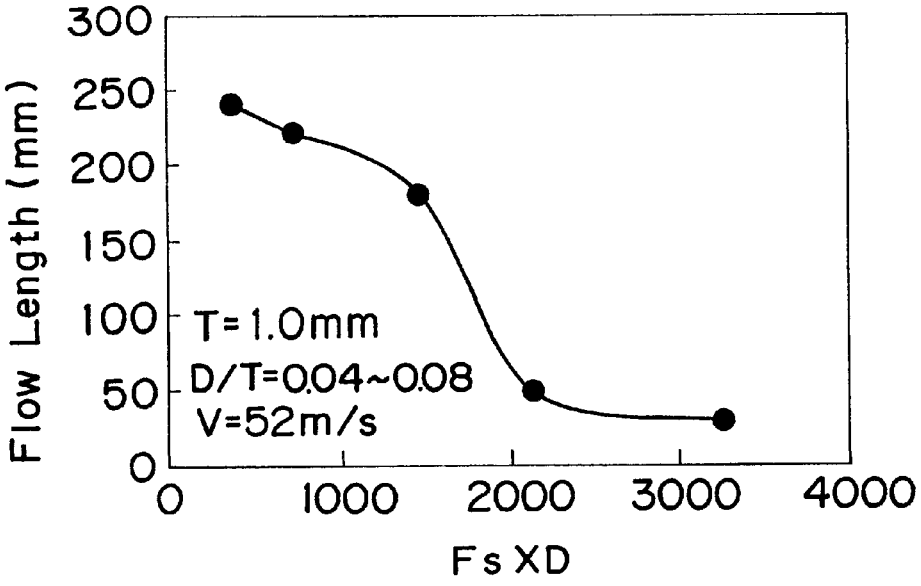
FIG. 5 is a graph showing a relationship between the product of solid fraction Fs and grain size D of the solid phase, and flow length.

The results of the fluidity test are shown in FIGS. 3 to 5. FIG. 3 shows that fluidity lowers rapidly as the value of D/T increases beyond 0.13, while the fluidity remains stable at a satisfactory level when the value of D/T is within 0.1. FIG. 4 shows that a velocity V lower than 30 m/s results in very low fluidity while a velocity V not lower than 50 m/s results in a flow length longer than 200 mm that is empirically considered to be desirable, and makes it possible to reliably achieve high quality. FIG. 5 shows that fluidity lowers significantly as the value of $Fs \times D$ increases beyond 1500, while a value of $Fs \times D$ not higher than 800 results in a flow length longer than 200 mm, thus making it possible to further improve the quality.

Figure 7:
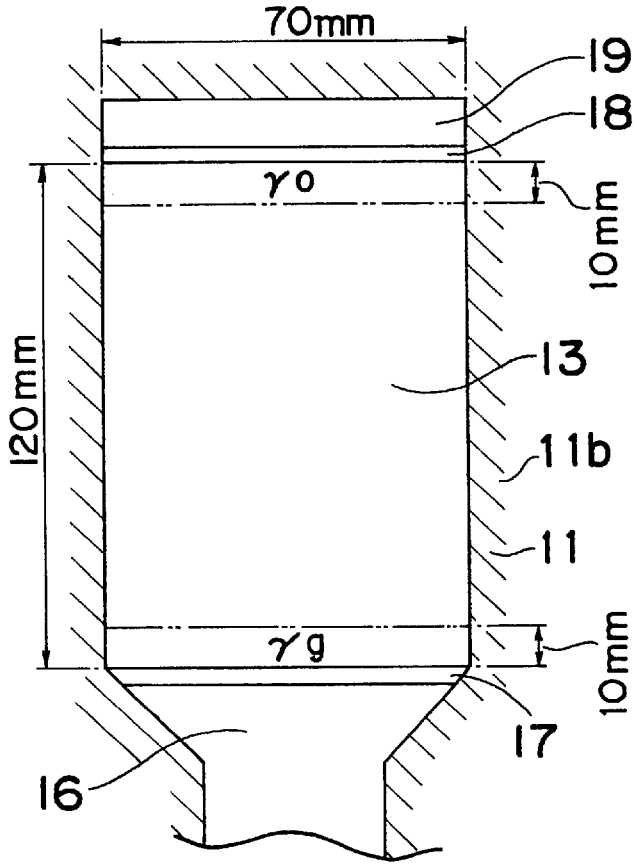
FIG. 7 is a schematic diagram showing cavity configuration of a mold used for density measurement tests.

Next, a mold cavity 13 having a substantially rectangular box shape measuring 120 mm by 70 mm by 1 mm was formed as shown in FIG. 7. In FIG. 7, the cavity is connected to a product gate 17, an overflow gate 18 and an overflow groove 19. The ratio To/Tg of the thickness of the overflow gate portion to the thickness of the product gate portion was changed so as to examine the change in ratio $\gamma o/\gamma g$ of the specific gravity $\gamma o$ of a region of the product portion around the overflow gate 18 (a region within 10 mm from the overflow gate 18) to the specific gravity $\gamma g$ of a region around the product gate 17 (a region within 10 mm from the product gate 17).

Figure 8:
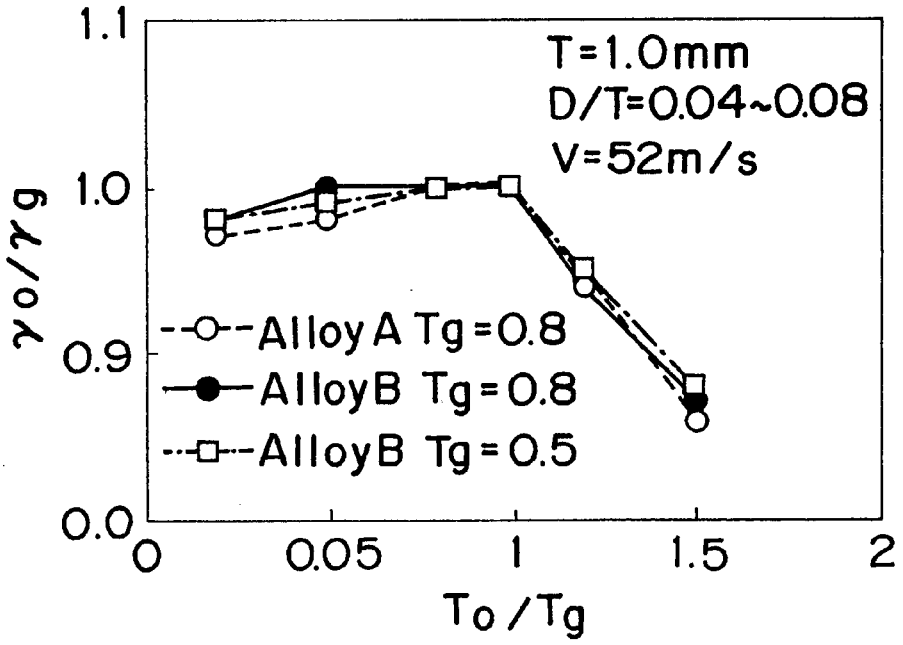
FIG. 8 is a graph showing a relationship between ratio to/Tg of thickness of the overflow gate to thickness of the product gate and the ratio $\gamma o/\gamma g$ of specific density of the product portion near the overflow gate to that of a portion near the product gate.
Figure 9:
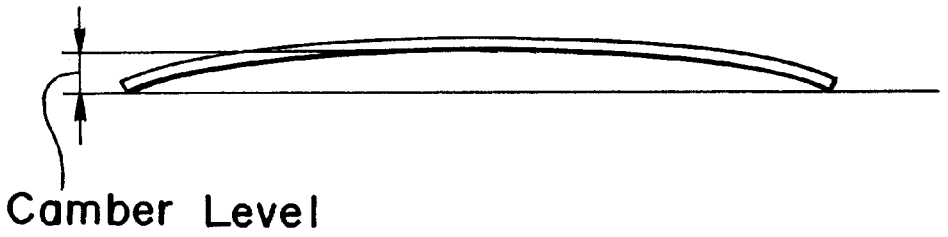
FIG. 9 is a schematic diagram showing the procedure of warp measurement tests.

The results of the specific gravity measuring test are shown in FIG. 8. It is shown that the ratio $\gamma o/\gamma g$ decreases as the ratio To/Tg is higher than 1.0. It is supposed that the ratio $\gamma o/\gamma g$ decreases due to gas occupying a space near the overflow gate because it is difficult for the gas to enter the space near the product gate and the specific gravity thereof remains stable. Consequently, an excessively high value of To/Tg leads to poor degassing to the overflow groove, resulting in lower quality of the product portion near the overflow gate.

Then, the effect of the solid fraction Fs on the change in the amount of warp of the product portion of an article molded with the mold shown in FIG. 7 was examined. The amount of warp was measured in terms of the deviation of a substantially central position of the product portion from a reference line connecting both end portions.

Figure 10:
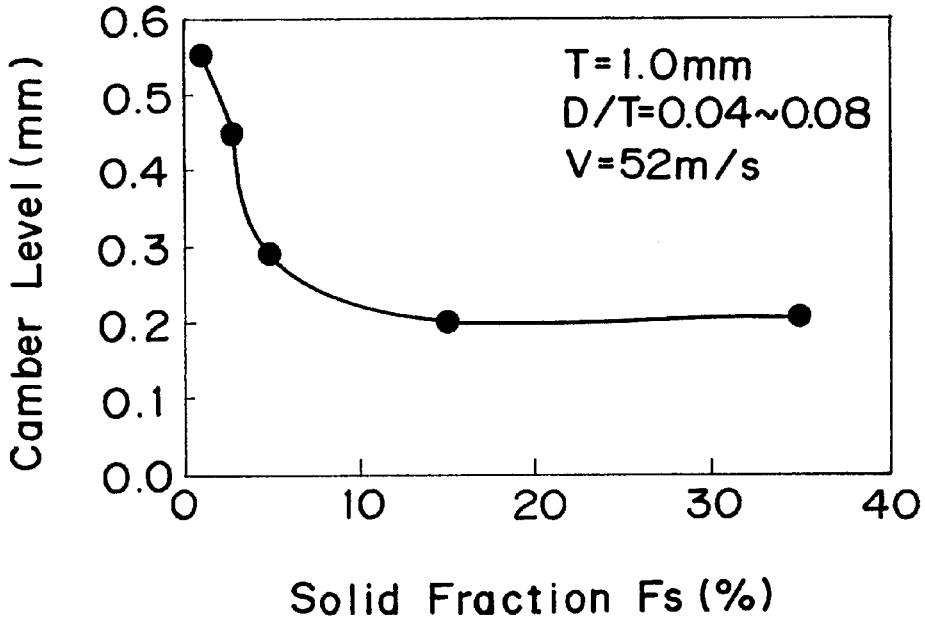
FIG. 10 is a graph showing a relationship between the solid fraction Fs and the amount of warp.

The results of the warp measuring test are shown in FIG. 10. It is shown that the amount of warp exceeds 0.3 mm when the value of Fs is less than 3%, making the molded article unsuitable for practical use.

According to the invention as described above, when producing the thin molded product by injecting molten metal in a semi-melting state into the cavity of the mold, the grain size of the solid phase, which is the average diameter of solid phase of the molten metal, is set to not more than 0.13 times the average thickness of the product portion of the thin molded product corresponding to the cavity, thus making it possible to improve the molten metal fluidity and thereby improve the quality of the thin molded product.

According to the invention the molten metal velocity at the product gate is set to not less than 30 m/s thus making it possible to further improve the quality of the thin molded product.

According to the invention the solid fraction Fs (%) of the molten metal and grain size of the solid phase D ($\mu$m) of the molten metal are set to satisfy the following relationship $Fs \times D \leqq 1500$, thus making it possible to further enhance the effects of the invention.

According to the invention the solid fraction of the molten metal is set within a range from 3 to 40%, thus making it possible to maintain better quality of the thin molded product while minimizing deformation thereof.

According to the invention the overflow gate is provided in the mold at a position opposite to the product gate with respect to the cavity, and the thickness of an overflow gate portion of the thin molded product corresponding to the overflow gate is set to a value within a range from 0.1 to 1.0 times the thickness of the product gate portion of the product gate, thus making it possible to achieve satisfactory degassing to the overflow groove and thereby improve the quality of the product portion of the thin molded product as a whole.

What is claimed is:

1. A method for semi-molten metal injection molding of a thin molded product, the method comprising the steps of:

preparing a semi-molten mixture which is a magnesium alloy, wherein the semi-molten metal mixture is formed in a cylinder by heating and semi-melting the material charged by a screw from the back side of the cylinder while the screw is agitating the material in the cylinder;

injecting the semi-molten metal mixture into a mold cavity in the mold wherein the semi-molten metal mixture is pressurized in a front end portion in the cylinder by pushing the screw toward the nozzle of the cylinder, and injected from the nozzle into the mold cavity through a product gate which is throttled in the mold communicated to the nozzle, wherein the mold cavity comprises a product portion for molding the thin molded product which portion has at least one of a wall thickness, between opposite surfaces thereof, of not more than 1.5 mm in 50% or more of the surface area of a product portion and a wall thickness, between opposite surface thereof, in a ratio of not more than 0.75 mm of the volume in $mm^3$ of the product portion divided by the area in $mm^2$ of both opposite surfaces of the product portion, and the semi-molten metal mixture injected into the product portion has an average grain size of a solid phase set to be not more than 0.13 times an average thickness of the product portion, solidifying the semi-molten metal mixture in the mold cavity to mold the thin molded product in the product portion of the mold cavity; and releasing the thin molded product from the product portion of the mold.

2. The method according to claim 1, wherein a velocity of the semi-molten metal at the product gate is set to not less than 30 m/s.

3. The method according to claim 1, wherein a solid fraction Fs (%) of the molten metal and the grain size of 15 the solid phase D ($\mu$m) of the molten metal are set so as to satisfy the relationship: $Fs \times D \leqq 1500$.

4. The method according to claim 3, wherein a fraction solid in the molten metal to be injected is set within a range of 3 to 40%.

5. The method according to claim 1, wherein an overflow gate is provided in the mold at a opposite position of the cavity to the product gate, and a thickness of an overflow gate portion of the thin molded product corresponding to the overflow gate is set to be within a range from 0.1 to 1.0 times a thickness of a product gate portion corresponding to the product gate.

* * * * *